United States Patent [19]

Robert

[11] Patent Number: 4,497,656

[45] Date of Patent: Feb. 5, 1985

[54] STEEL MAKING METHOD

[75] Inventor: Edgardo J. Robert, Buenos Aires, Argentina

[73] Assignee: Pennsylvania Engineering Corporation, Pittsburgh, Pa.

[21] Appl. No.: 391,134

[22] Filed: Jun. 23, 1982

[51] Int. Cl.[3] ..... C21C 7/00

[52] U.S. Cl. ..... 75/60; 75/51; 75/52; 75/59

[58] Field of Search ..... 75/51, 52, 59, 60

[56] References Cited

U.S. PATENT DOCUMENTS 4,329,171 5/1982 Robert ..... 75/60

*Primary Examiner*—P. D. Rosenberg

*Attorney, Agent, or Firm*—Fred Wiviott

[57] ABSTRACT

A method of producing steel from ferrous hot metal containing carbon includes the steps of delivering oxygen and a surrounding sheath of hydrocarbon shielding fluid to the metal and beneath its surface to elevate the temperature to at least 1350° C. Iron material taken from the group consisting of prereduced iron ore, prereduced iron pellets and iron ore or combinations thereof are then delivered to the metal at controlled rates. The rate of charging is balanced with the heat input to the bath, in order to maintain or increase the bath temperature. The heat input is supplied by the simultaneous injection of carbon and oxygen through bottom tuyeres. The rate of carbon injection is also regulated to maintain the carbon content in the bath at the desired level. After charging of the iron material has been completed, the delivery of carbon is terminated while the delivery of oxygen and hydrocarbon shielding fluid is continued until the metal carbon level is reduced at desired level, and the refining of steel is effected.

2 Claims, 1 Drawing Figure

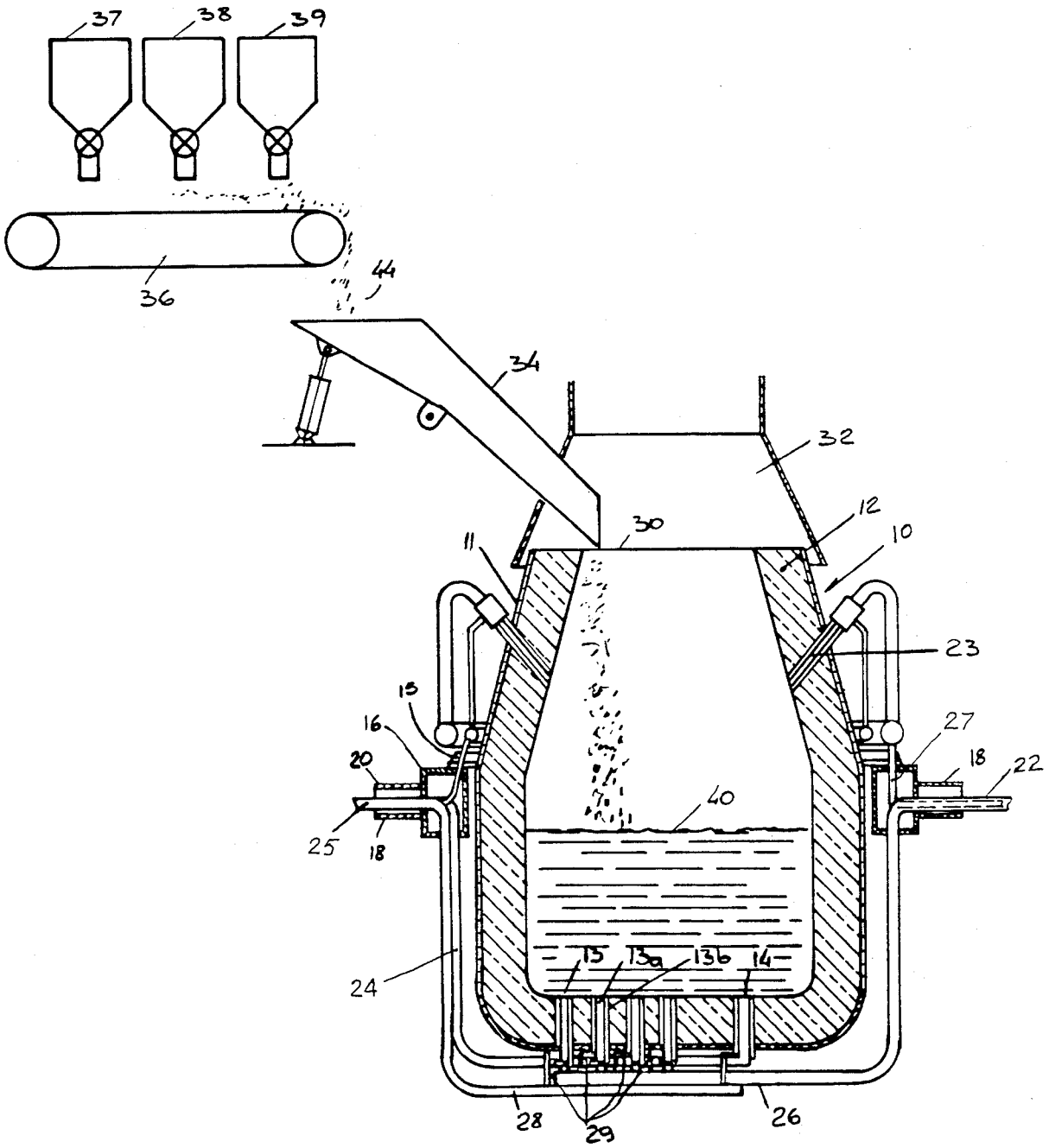
37
38
39
36
44
34
32
30
12
10
11
23
15
16
20
27
18
22
25
18
40
24
15
13a
13b
14
28
29
26

STEEL MAKING METHOD

BACKGROUND OF THE INVENTION

This invention relates to a bottom-blown steel making process.

One well-known steel making process involves refining pig iron by top or bottom blowing with oxygen. When bottom blowing is employed, a sheath of hydrocarbon shielding fluid, such as propane, natural gas or light oil is injected in surrounding relation to the oxygen in order to prolong tuyere and refractory life. Because solid iron bearing materials, such as scrap and prereduced pelletized iron are relatively cheaper than hot metal, it is often desirable in such processes to employ a solid charge to the extent possible. The percentage of solid metal to hot metal charge is generally limited by the heat generated during the exothermic reactions between the oxygen and impurities in the hot metal, such as carbon, silicon, phosphorous and manganese.

The proportion of solid charge may be increased somewhat by using the bottom tuyeres as preheating burners. Such tuyeres generally include an inner pipe for carrying oxygen and a second pipe spaced from the inner pipe to provide an outer annulus for delivering the hydrocarbon shielding fluid. In such tuyeres, the area of the gap between the pipes is relatively much smaller than the area of the inner oxygen carrying pipe because the volume of shielding fluid required during normal operation is only about 1–10% of the volume of oxygen. This severely restricts the capacity of such tuyeres to act as preheating burners because the relatively small area of the outer annulus severely limits the quantity of hydrocarbon that can be provided for preheating. One attempt to increase the hydrocarbon available for preheating involves the use of a dual supply system for providing hydrocarbon in liquid form during preheating and/or solid form during refining. At the same time oxygen is injected through side tuyeres 23. Above the liquid level in order to combust to $CO_2$ part of the CO generated during the process.

A steel making process which would permit the usage of partially reduced iron ore or even iron ore in high percentages of the charge without formation of "ferro-bergs" would be an advancement in the art.

SUMMARY OF THE INVENTION

It is an object of the invention to provide a new and improved steel making process.

Another object of the invention is to provide a steel making process which permits the use of a solid furnace charge without the necessity of batch charging systems.

A further object of the invention is to provide a steel making process which utilizes a cold charge other than scrap.

Yet another object of the invention is to provide a pneumatic steel making process in which the furnace charge includes partially prereduced iron pellets, prereduced iron ore and/or iron ore.

These and other objects and advantages of the present invention will become more apparent from the detailed description thereof taken with the accompanying drawing.

In general terms, the invention comprises a method of producing steel from ferrous hot metal containing carbon, comprising the steps of delivering oxygen and/or oxygen/lime and a surrounding sheath of hydrocarbon shielding fluid to the hot metal and beneath its surface to elevate the temperature thereof to a preselected level, delivering a solid form material taken from the group consisting of prereduced iron ore, iron ore and prereduced iron pellets or combinations thereof to the hot metal at a controlled rate, the solid form iron material tending to lower the temperature of said hot metal, delivering carbon to said metal at a controlled rate and simultaneously with the delivery of said iron material, the feed rate of carbon being regulated to maintain the carbon level in the metal substantially constant as the same is oxidized by said oxygen, and terminating the delivery of iron material and carbon to the metal while continuing to deliver oxygen and shielding fluid to reduce the level of carbon therein to a preselected level.

BRIEF DESCRIPTION OF THE DRAWINGS

The single FIGURE of the drawing schematically illustrates the vessel in which the process according to the invention may be carried out.

DESCRIPTION OF THE PREFERRED EMBODIMENT

The method of the invention may be carried out in the vessel 10 shown in the drawing, although those skilled in the art will appreciate that it is exemplary. The vessel 10 is generally pear-shaped in vertical section and includes a metallic shell 11 and a refractory lining 12. A first group of tuyeres 13 extend through the lower end of the vessel and each includes an inner pipe 13*a* and a concentric outer pipe 13*b* spaced from the inner pipe to permit the injection of oxygen and surrounding sheath of hydrocarbon shielding fluid. In addition, one or more additional tuyeres 14 may extend through the vessel refractory adjacent its lower end delivers carrier gas/-carbon mixtures during the carbon injection period, and innert gas during the remaining period. Pipe 27 deliveries pure oxygen or an oxidizing gas for afterburning. For a more detailed description of the manner that pipes 22, 24 and 25 are passed through trunnion pins 18 and the manner in which the same are connected to the tuyeres, reference is made to U.S. Pat. No. 3,810,297.

Disposed above the open upper end 30 of the vessel 10 is the movable skirt 32 of a gas collecting hood which is connected to a conventional gas cleaning system (not shown) in a well-known manner. The lower end of a charging chute 34 extends through hood 32 and its upper end is positioned for receiving solid charged materials from a conveyor 36 positioned below material storage hoppers 37, 38 and 39. In practicing the process of the invention, the vessel 10 is first charged with molten pig iron which may typically contain about 3–4% carbon, 0.7% silicon and 0.7% manganese. During charging, an inert gas, such as argon or nitrogen, is delivered to each of the tuyere pipes 13*a*, 13*b* and 14 to prevent the backflow of metal into the tuyeres 13. After charging with hot metal has been completed, oxygen is delivered to the inner tuyere pipe 13*a* and a hydrocarbon shielding fluid to the outer tuyere pipe 13*b*. Powdered lime or some other fluxing agent may be entrained in the oxygen stream. The level of shielding fluid delivered will be about 1–10% by volume of oxygen for purposes which will also be discussed more fully below. It is also included for purposes that also will be explained below, one or more tuyeres over the slag line 23.

Converter vessels of the type illustrated are generally supported in a conventional manner by means of a plurality of peripherally spaced apart brackets 15 which engage and are releasably secured to a hollow trunnion ring 16 surrounding the vessel 10. Trunnion pins 18 extend from each of the opposite sides of ring 16 and are suitably supported in a well-known manner on conventional bearing structures (not shown) and one trunnion pin is coupled to a suitable driver mechanism (not shown) for tilting the vessel to each of a plurality of possition as may be required during a process cycle.

The trunnion pins 18 may each have a hollow bore for respectively receiving gas or gas/powder delivery pipe and hydrocarbon delivery pipes 25. Additional pipes (not shown) may also be provided for delivering cooling water to the hollow trunnion ring 16 and other areas of the vessel, and particularly those portions adjacent its upper end. Pipe 22 is connected at its lower end to a first manifold 26 which in turn is connected to each of the central tuyere pipes 13*a*. Similarly, the hydrocarbon shielding fluid delivery pipe 24 is connected at its lower end to a manifold pipe 28 which in turn is connected by short feeder pipes 29 to the gap between tuyere pipes 13*a* and 13*b* and the hydrocarbon delivery pipe 25 is similarly connected to the tuyeres 14. Pipe 24 as a result of the exothermic reactions between the oxygen and the carbon, silicon and other impurities in the hot metal, a substantial amount of heat will be generated. When the temperature of the liquid metal reaches about 1350° C., iron material in a solid form, such as prereduced or partially reduced iron pellets, iron ore or prereduced iron ore or combinations thereof, is delivered from one of the hoppers 37, 38 or 39 to the conveyor which in turn deposits the same in the upper end of the chute 34. For example, the iron material may be partially prereduced so that the degree of metallization is less than 86%. In addition, this material may be pellets or briquettes. The iron material is fed from chute 34 at a controlled rate into the furnace bath 40.

Simultaneously with the delivery of iron 44, a measured quantity of carbon, preferably in the form of fines of coke, carbon or other fuel, will also be directed to the furnace bath. This may be done through the tuyere 14 using nitrogen or some other inert gas as a carrier.

The tuyere is also protected by the injection of an hydrocarbon fluid through the annular gap between the outer pipe and the inner pipe. The iron material will have a tendency to chill the melt which must be balanced by the oxidation of the carbon addition. Therefore, carbon will be fed into the vessel at a rate which will maintain the level of carbon in the bath 40 substantially constant. In this manner, the temperature of the bath can be maintained at a minimum of 1350° C. during the charging of the iron material 44. In the event the iron material is not completely reduced, that is, if it retains some oxygen, the level of the oxygen fed into the vessel can be reduced accordingly.

Since the oxygen blown through tuyeres 13 is balanced with carbon injected through tuyere 14, the exit gas will result mainly CO. Some post combustion will be effected by means of tuyeres 23 that will blow oxygen or an oxygen rich gas. Tuyere 23 are also protected by the injection of an hydrocarbon through the annulus.

The rate at which the iron material will be fed into the furnace will depend upon the cold charge rate desired, but is in the range of 0.6 to 1.5 kg/ton of liquid steel per minute per each percent of cold charge rate. The rate of carbon charge will depend upon the chemical analysis of the prereduced iron, and in particular to the iron oxide content. After the charge of iron has been completed, the delivery of carbon will also be terminated. The blowing of oxygen and hydrocarbon shielding fluid will be continued, however, until the levels of carbon, silicon and manganese are reduced to desired levels. Lime may also be delivered to the bath in any convenient manner, such as by being entrained in powdered form in the oxygen stream. At the end of the oxygen blow, carbon may be injected to bring the carbon level in the bath within the desired specification and iron oxide may be charged for temperature control. Upon the completion of the oxygen blow, inert gases will again be delivered to the lower tuyeres while the hot metal is being poured. It will also be appreciated that when the delivery of carbon is terminated, the pressure of inert gas in tuyeres 14 will have to be maintained sufficiently to prevent the backflow of molten metal.

While only a single embodiment of the invention has been illustrated and described, it is not intended to be limited thereby but only by the scope of the appended claims.

I claim:

1. A method of producing steel from ferrous hot metal containing carbon, comprising the steps of:

delivering oxygen and a surrounding sheath of hydrocarbon shielding fluid to said metal and beneath its surface to elevate the temperature thereof to a preselected level, delivering a solid iron material taken from the group consisting of prereduced iron ore, prereduced iron pellets and at least partially prereduced iron ore to said hot metal at a controlled rate, said iron material tending to lower the temperature of said metal, entraining carbon in particulate form in an inert gas and delivering the same to said metal at a controlled rate beneath the surface of said metal and simultaneously with the delivery of said iron material, the feed rate of said carbon being such as to maintain the carbon level in said metal at a substantially constant level as the same is oxidized by said oxygen, injecting a hydrocarbon shielding fluid in surrounding relation to said carbon, terminating the delivery of said iron material and carbon to said metal while continuing to deliver oxygen and shielding fluid to reduce the level of carbon therein to a preselected level.

2. The method set forth in claim 1 and including the step of injecting oxygen above the surface of said metal.

* * * * *